US008983351B2

(12) United States Patent
Koyama

(10) Patent No.: US 8,983,351 B2
(45) Date of Patent: Mar. 17, 2015

(54) FIXING DEVICE

(75) Inventor: Tatsuya Koyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 68 days.

(21) Appl. No.: 13/334,170

(22) Filed: Dec. 22, 2011

(65) Prior Publication Data

US 2012/0163889 A1 Jun. 28, 2012

(30) Foreign Application Priority Data

Dec. 24, 2010 (JP) ..... 2010-288620

(51) Int. Cl.
*G03G 15/20* (2006.01)

(52) U.S. Cl.
CPC .... *G03G 15/2053* (2013.01); *G03G 2215/2035* (2013.01)
USPC ..... 399/329

(58) Field of Classification Search
USPC ..... 399/328, 329, 341
See application file for complete search history.

(56) References Cited

U.S. PATENT DOCUMENTS

| | | | |
|---|---|---|---|
| 4,187,033 | A | 2/1980 | Zukowski |
| 6,456,818 | B1 | 9/2002 | Nakayama et al. |
| 6,501,935 | B2 | 12/2002 | Hirai et al. |
| 6,830,212 | B1 | 12/2004 | Harris |
| 7,242,895 | B2 | 7/2007 | Inada et al. |
| 7,283,780 | B2 | 10/2007 | Uchida et al. |
| 7,359,666 | B2 | 4/2008 | Takashi et al. |
| 7,593,678 | B2 | 9/2009 | Suenaga |
| 7,664,448 | B2 | 2/2010 | Lee et al. |
| 7,881,650 | B2 | 2/2011 | Shin et al. |
| 7,965,970 | B2 | 6/2011 | Haseba et al. |
| 8,032,069 | B2 | 10/2011 | Shin et al. |
| 8,131,197 | B2 | 3/2012 | Hiraoka et al. |
| 2001/0022909 | A1 | 9/2001 | Takeuchi et al. |
| 2002/0018676 | A1 | 2/2002 | Hirai et al. |

(Continued)

FOREIGN PATENT DOCUMENTS

| | | | |
|---|---|---|---|
| CN | 101261481 | A | 9/2008 |
| CN | 101846944 | A | 9/2010 |

(Continued)

OTHER PUBLICATIONS

Machine translation of JP 2004-198556.*

(Continued)

*Primary Examiner* — David Bolduc
*Assistant Examiner* — Barnabas Fekete
(74) *Attorney, Agent, or Firm* — Banner & Witcoff, Ltd.

(57) ABSTRACT

A fixing device includes a tubular member, a nip member, a backup member, and a bias member. The tubular member has an outer peripheral surface, an inner peripheral surface defining an internal space, and an axis defining an axis direction. The nip member is in contact with the inner peripheral surface. The backup member is opposed to the nip member and in contact with the outer peripheral surface to form a nip region for nipping a sheet conveyed in a conveying direction orthogonal to the axis direction. The backup member is configured to move in the conveying direction and the tubular member is configured to circularly move around the axis in accordance with the movement of the backup member due to a friction force generated between the tubular member and the backup member. The bias member protrudes toward the backup member through a bias region.

23 Claims, 7 Drawing Sheets

(56) References Cited

U.S. PATENT DOCUMENTS

| | | | | |
|---|---|---|---|---|
| 2002/0039504 | A1 | 4/2002 | Nakayama et al. | |
| 2003/0185604 | A1 | 10/2003 | Sato | |
| 2005/0185994 | A1 | 8/2005 | Inada et al. | |
| 2005/0191097 | A1 | 9/2005 | Yoshida et al. | |
| 2007/0059001 | A1 | 3/2007 | Matsuura et al. | |
| 2007/0059022 | A1 | 3/2007 | Yamaoka et al. | |
| 2007/0212135 | A1 | 9/2007 | Suenaga | |
| 2008/0112739 | A1 | 5/2008 | Shinshi | |
| 2008/0124147 | A1 | 5/2008 | Uehara et al. | |
| 2008/0219723 | A1 | 9/2008 | Lee et al. | |
| 2008/0292374 | A1 | 11/2008 | Hiraoka et al. | |
| 2008/0317522 | A1 | 12/2008 | Ardery et al. | |
| 2009/0047047 | A1 | 2/2009 | Ardery et al. | |
| 2009/0080954 | A1 | 3/2009 | Miyata et al. | |
| 2009/0092423 | A1 | 4/2009 | Shin et al. | |
| 2009/0208264 | A1 | 8/2009 | Fujiwara et al. | |
| 2010/0202809 | A1 | 8/2010 | Shinshi et al. | |
| 2010/0247183 | A1 * | 9/2010 | Haseba et al. | 399/329 |
| 2011/0091254 | A1 | 4/2011 | Shin et al. | |
| 2011/0129267 | A1 | 6/2011 | Arimoto et al. | |
| 2011/0170917 | A1 | 7/2011 | Yoshikawa et al. | |
| 2012/0093548 | A1 | 4/2012 | Kimura | |

FOREIGN PATENT DOCUMENTS

| | | | |
|---|---|---|---|
| JP | H04-122969 | A | 4/1992 |
| JP | 05-341685 | A | 12/1993 |
| JP | 06-118823 | A | 4/1994 |
| JP | 06-282183 | | 10/1994 |
| JP | 08-248791 | | 9/1996 |
| JP | 10-268681 | A | 10/1998 |
| JP | 10-340017 | | 12/1998 |
| JP | 2000-330417 | | 11/2000 |
| JP | 2002-123107 | A | 4/2002 |
| JP | 2003-316181 | | 11/2003 |
| JP | 2004-198556 | A | 7/2004 |
| JP | 2005-010201 | | 1/2005 |
| JP | 2005-234294 | A | 9/2005 |
| JP | 2007-017772 | | 1/2007 |
| JP | 2007-279665 | A | 10/2007 |
| JP | 2008-224878 | A | 9/2008 |
| JP | 2008-233886 | | 10/2008 |
| JP | 2008-292793 | A | 12/2008 |
| JP | 2009-093141 | A | 4/2009 |
| JP | 2009-237089 | | 10/2009 |

OTHER PUBLICATIONS

Non-final Office Action received in U.S. Appl. No. 13/334,157 mailed May 15, 2013.
Co-pending U.S. Appl. No. 13/334,165, filed Dec. 22, 2011.
Co-pending U.S. Appl. No. 13/334,157, filed Dec. 22, 2011.
Co-pending U.S. Appl. No. 13/334,183, filed Dec. 22, 2011.
Extended EP Search Report mailed May 3, 2012, EP Appln. 11192796.8-2216.
JP Office Action mailed Jan. 22, 2013, JP Appln. 2010-288620, English Translation.
JP Office Action mailed Jan. 15, 2013, JP Appln. 2010-287935, English Translation.
JP Office Action mailed Jan. 15, 2013, JP Appln. 2010-287377, English Translation.
JP Office Action mailed Jan. 15, 2013, JP Appln. 2010-287371, English Translation.
Non-Final Office Action issued in U.S. Appl. No. 13/334,183 mailed Dec. 4, 2013.
Machine translation of JP06-118823.
Non-final Office Action received in U.S. Appl. No. 13/334,165 mailed Sep. 4, 2013.
Final Office Action issued in U.S. Appl. No. 13/334,157 mailed Oct. 22, 2013.
CN First Office Action mailed Jan. 21, 2014, CN appln. 201110441042.5, English Translation.
Notice of Allowance issued in corresponding U.S. Appl. No. 13/334,165, mailed Jan. 30, 2014.
Notice of Allowance issued in corresponding U.S. Appl. No. 13/344,157 mailed Feb. 28, 2014.
Notice of Allowance issued in corresponding U.S. Appl. No. 13/334,183 mailed Mar. 13, 2014.

* cited by examiner

FIXING DEVICE

CROSS REFERENCE TO RELATED APPLICATION

This application claims priority from Japanese Patent Application No. 2010-288620 filed Dec. 24, 2010. The entire content of the priority application is incorporated herein by reference.

TECHNICAL FIELD

The present invention relates to a fixing device that thermally fixes a developing agent image transferred on a sheet.

BACKGROUND

A conventional fixing device includes an endless fusing film, a heater disposed in an internal space of the fusing film, and a nip plate defining a nip portion relative to a pressure roller through the fusing film. Due to a friction force that generates between the fusing film and the pressure roller, the fusing film is circularly moved in accordance with a rotation of the pressure roller driven by a motor.

SUMMARY

However, when a recording sheet passes between the fusing film and the pressure roller, the friction force can be reduced, thereby the fusing film may slip. If the fusing film slips, a developer image cannot be fixed on the recording sheet successfully.

It is an object of the invention to provide a fixing device capable of restraining a slip of a fusing film.

In order to attain the above and other objects, the present invention provides a fixing device including a flexible tubular member, a nip member, a backup member, and a bias member. The tubular member has an outer peripheral surface, an inner peripheral surface defining an internal space, and an axis defining an axis direction. The nip member is configured to be in contact with the inner peripheral surface. The backup member is opposed to the nip member and configured to be in contact with the outer peripheral surface to form a nip region for nipping a sheet conveyed in a conveying direction orthogonal to the axis direction. The sheet has a width in a width direction orthogonal to the conveying direction. The backup member is configured to move in the conveying direction and the tubular member is configured to circularly move around the axis in accordance with the movement of the backup member due to a friction force that generates between the tubular member and the backup member. The bias member protrudes toward the backup member through a bias region that is only outside of a width region corresponding to the width to bias the tubular member to the backup member.

Another aspect of the present invention provides a method for manufacturing a fixing device. The fixing device includes a flexible tubular member, a nip member, a backup member, and a bias member. The tubular member has an outer peripheral surface, an inner peripheral surface defining an internal space, and an axis defining an axis direction. The nip member is configured to be in contact with the inner peripheral surface. The backup member is opposed to the nip member and configured to be in contact with the outer peripheral surface to form a nip region for nipping a sheet conveyed in a conveying direction orthogonal to the axis direction. The sheet has a width in a width direction orthogonal to the conveying direction. The backup member is configured to move in the conveying direction and the tubular member is configured to circularly move around the axis in accordance with the movement of the backup member due to a friction force that generates between the tubular member and the backup member. The bias member protrudes toward the backup member through a bias region that is only outside of a width region corresponding to the width to bias the tubular member to the backup member. The nip member has a first surface and a second surface nearer to the backup member than the first surface. The method includes: determining, based on a desired protruding distance and a possible size of the bias member, a position of the bias member; and disposing the bias member at the determined position.

A fixing device includes: a tubular film; a nip plate; a backup roller; and a protruding member. The tubular film has an outer peripheral surface, an inner peripheral surface defining an internal space, and an axis defining an axis direction. The nip plate that is configured to be in contact with the inner peripheral surface. The backup roller that is opposed to the nip member and configured to be in contact with the outer peripheral surface to form a nip region for nipping a sheet conveyed in a conveying direction orthogonal to the axis direction. The sheet has a width in a width direction orthogonal to the conveying direction. The backup roller is configured be driven to rotate and the tubular film is configured to circularly move around the axis in accordance with the rotation of the backup roller. The protruding member protrudes toward the backup roller through a protruding region that is only outside of a width region corresponding to the width.

BRIEF DESCRIPTION OF THE DRAWINGS

In the drawings:

FIG. 6(*b*) is a cross-sectional view of the nip plate according to the second embodiment.

DETAILED DESCRIPTION

First Embodiment

Figure 1:
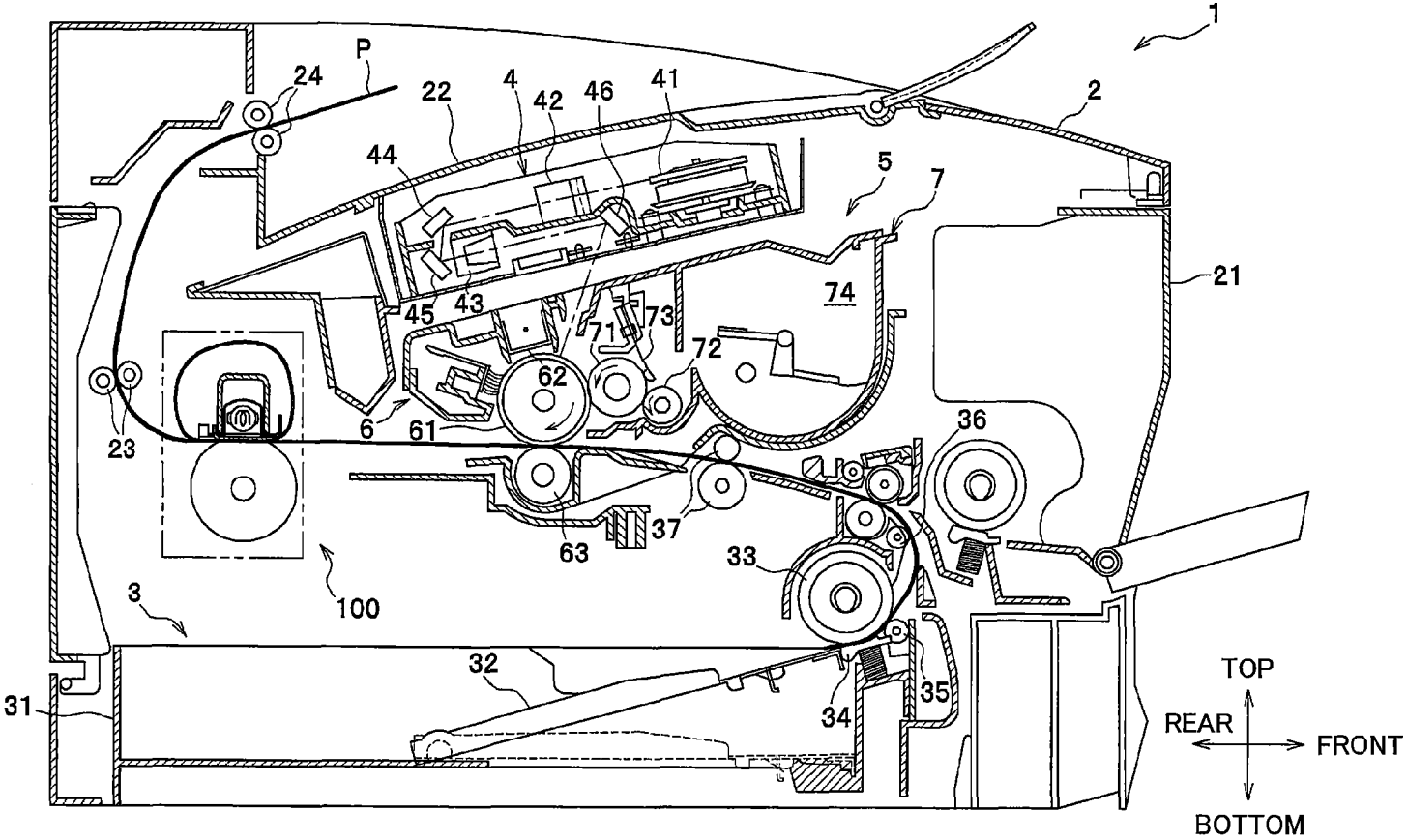
FIG. 1 is a schematic cross-sectional view showing a structure of a laser printer having a fixing device according to a first embodiment of the present invention.

Next, a general structure of a fixing device according to a first embodiment of the present invention will be described with references. A laser printer 1 shown in FIG. 1 is provided with a fixing device 100 according to the embodiment of the present invention. A detailed structure of the fixing device 100 will be described later.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (a developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
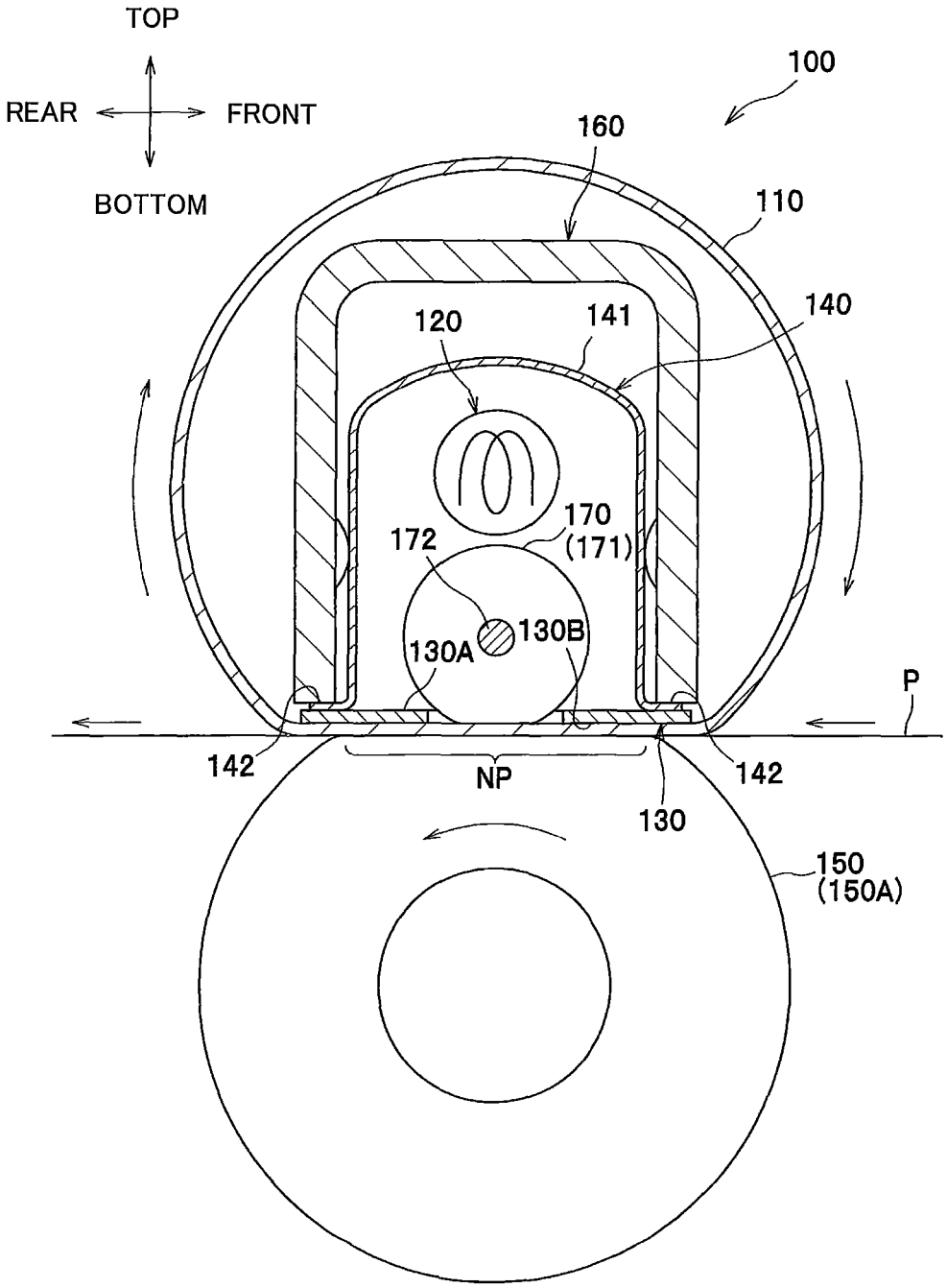
FIG. 2 is a schematic cross-sectional view showing a structure of the fixing device according to the first embodiment.

As shown in FIG. 2, the fixing device 100 includes a fusing film 110, a halogen lamp 120, a nip plate 130, a reflection plate 140, a pressure roller 150, a stay 160, and a pair of rotating members 170.

The fusing film 110 has an endless (tubular) configuration having heat resistivity and flexibility. Each end portion of the fusing film 110 in an axis direction (left to right direction in FIG. 2) is guided by a guide member 180 (FIG. 4), thereby the fusing film 110 is circularly movable. The fusing film 110 slid-contacts the nip plate 130 through grease. The grease may not be necessarily coated between the fusing film 110 and the nip plate 130 if the material of the fusing film 110 and the nip plate 130 does not need the grease.

The halogen lamp 120 is a conventional heater for heating toner on the sheet P by heating the nip plate 130 and the fusing film 110. The halogen lamp 120 is positioned at an internal space of the fusing film 110 and is spaced away from inner surfaces of the fusing film 110 and the nip plate 130 by a predetermined distance.

The nip plate 130 is adapted to receive radiant heat radiated from the halogen lamp 120 and is disposed so as to slide-contact the inner surface of the fusing film 110. The nip plate 130 transmits the radiant heat radiated from the halogen lamp 120 to toner on a sheet P through the fixing film 110.

The nip plate 130 is formed from, for example, an aluminum plate having a heat conductivity higher than the stay 160 from a stainless. Note that in order to effectively absorb the radiant heat radiated from the halogen lamp 120, an upper surface 130A of the nip member 130 may be coated with black or a heat absorbing member.

Figure 3:
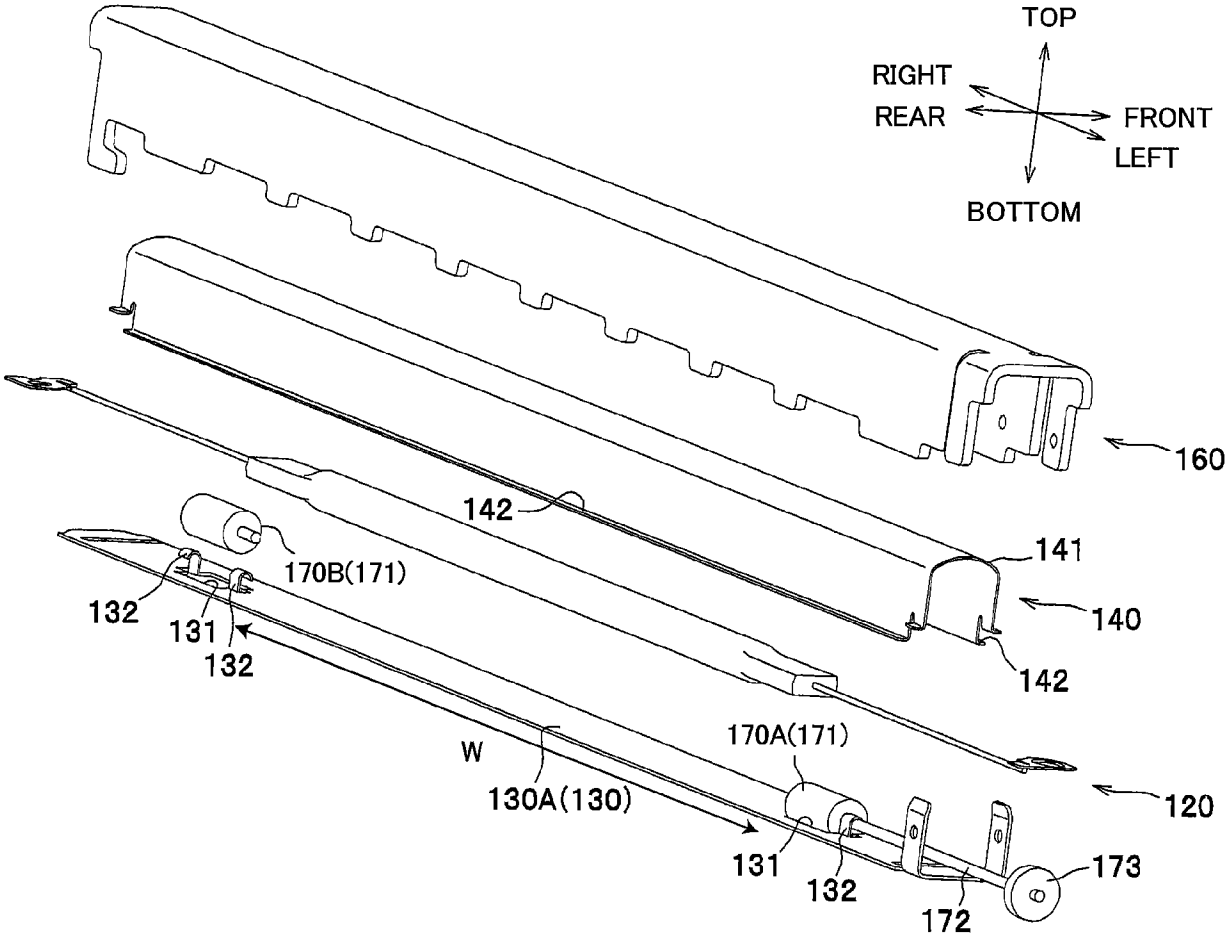
FIG. 3 is an exploded perspective view showing a halogen lamp, a nip plate, a reflection plate, and a stay.

As shown in FIG. 3, the nip plate 130 is formed with a pair of through-holes 131 in which the pair of rotating members 170 is disposed, respectively.

The pair of through-holes 131 is positioned at both ends of the nip plate 130 in the left-right direction, respectively, outside of a sheet conveying region W in the left-right direction, and at the center of the nip plate 130 in the front-rear direction. The sheet conveying region W means a width in the left-right direction of a maximum size of sheet on which the laser printer 1 can form an image.

Further, two pair of supporting members 132 are integrally formed on the nip plate 130 with sheet-metal processing. Each pair of supporting members 132 protrudes upwards from both ends of corresponding through-hole 130 in the left-right direction on the upper surface 130A of the nip plate 130, respectively, in order to rotatably supports a rotational shaft 172 (described later) of the corresponding rotating member 170.

As shown in FIG. 2, the reflection plate 140 is adapted to reflect radiant heat radiated in the frontward/rearward direction and the upper direction from the halogen lamp 120 toward the nip plate 130 (the upper surface 103A). The reflection plate 140 is positioned within the fusing film 110 and surrounds the halogen lamp 120, with a predetermined distance therefrom.

Thus, radiant heat radiated from the halogen lamp 120 can be efficiently concentrated onto the nip plate 130 to promptly heat the nip plate 130 and the fusing film 110.

The reflection plate 140 has a U-shape in cross-section and is made from a material such as aluminum having high reflection ratio regarding infrared ray and far infrared ray. Specifically, the reflection plate 140 has a U-shaped reflection portion 141 and a pair of flange portions 142 extending in the front-rear direction from both ends of the reflection portion 141, respectively. A mirror surface finishing is available on the surface of the aluminum reflection plate 140 for specular reflection in order to enhance heat reflection ratio.

The pressure roller 150 that is elastically deformable is positioned below the nip plate 130. By elastically deforming, the pressure roller 150 nips the fusing film 110 in cooperation with the nip plate 130 to provide a nip region N for nipping the sheet P between the pressure roller 150 and the fusing film 110.

Figure 4:
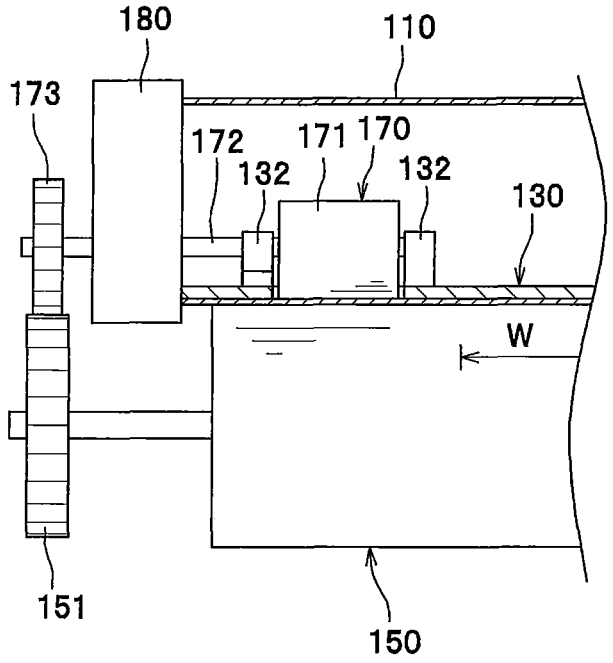
FIG. 4 is a cross-sectional view of the fusing device.

As shown in FIG. 4, a driving gear 151 is attached to one shaft of the pressure roller 150. The pressure roller 150 is rotationally driven with a driving force transmitted to the driving gear 151 from a drive motor (not shown) disposed in the main frame 2. In accordance with the rotation of the pressure roller 150, the fusing film 110 is circularly moved due to a friction force that generates between the fusing film 110 and the pressure roller 150 (or the sheet P). Thus, a toner image on the sheet P can be thermally fixed thereto by heat and pressure during passage of the sheet P at the nip region N between the pressure roller 150 and the fusing film 110.

The stay 160 is positioned within the fusing film 110 and surrounds the reflection plate 140 to support both ends of the nip plate 130 in the front-rear direction through the pair of flange portions 142 of the reflection plate 140. For fabricating the stay 160, a highly rigid member such as a steel plate is folded into U-shape following the outer surface of the reflection plate 140 (the reflection portion 141). Thus, the position shift of the reflection plate 140 in the top-bottom direction is restrained. Further, since the pair of flange portions 142 of the reflection plate 140 is supported by the stay 160 having a high rigidity, the rigidity of the reflection part 140 is also held.

The pair of rotating members 170 includes a first rotating member 170A disposed at the right side in FIG. 3 and a second rotating member 170B disposed at the left side in FIG. 3 to bias both ends of the fusing film 110 in the left-right direction, respectively, to a peripheral surface 150A of the pressure roller 150. Each rotating member 170 includes a bias member 171 and a rotational shaft 172.

As shown in FIGS. 2 and 3, each bias member 171 is disposed in the corresponding through-holes 131 and protrudes below a lower surface 130B of the nip plate 130 to bias the fusing film 110. Since the pair of through-holes 131 is formed outside of the sheet conveying region W in the left-right direction, the pair of bias members 171 results in being also disposed outside of the sheet conveying region W.

With this construction, even when the sheet P is passing between the fusing film 110 and the pressure roller 150, each bias member 171 does not contact the sheet P, that is, each bias member 171 can keep biasing the fusing film 110 to the pressure roller 150. Therefore, the rotation (the driving force) of the pressure roller 150 is reliably transmitted to the fusing film 110. Further, since the pair of bias members 171 does not contact the sheet P, it is prevented that the pair of bias members 171 interrupts the thermal fix.

Further, the pair of bias member 171 is disposed so as to overlap the nip portion NP as viewed from the left-right direction. With this construction, it becomes possible to reliably bias the fusing film 110 to the peripheral surface 150A of the pressure roller 150.

Each rotational shaft 172 is rotatably supported by the pair of supporting members 132 protruding upwards from the upper surface 130A. As the result, each bias member 171 is positioned upwards of the upper surface 130A.

As shown in FIGS. 3 and 4, the rotational shaft 172 of the first rotating member 170A extends leftward through the guide member 180. Further, the first rotating member 170A includes a driven gear 173 attached to the left end of the rotational shaft 172. The driven gear 173 is meshingly engaged with the driving gear 151 of the pressure roller 150. Thus, the driving force transmitted from the drive motor (not shown) to the pressure roller 150 is also transmitted to the rotational member 170A.

On the other hands, the rotating member 170B does not include the driven gear 173. Therefore, the rotating member 170B is rotated in accordance with the rotation of the fusing film 110 (the pressured roller 150) with the help of the friction force that generates between the rotating member 170B and the fusing film 110.

As described above, in the fusing device 100, the rotating member 170 protrudes below a lower surface 130B of the nip plate 130 to bias the fusing film 110 to the peripheral surface 150A of the pressure roller 150. Therefore, even if the friction force that generates between the fusing film 110 and the pressure roller 150 is reduced when the sheet P onto which the toner image is transferred passes between the pressure roller 150 and the heated fusing film 110 (nip portion NP), the driving force of the pressure roller 150 is reliably transmitted to the fusing film 110, thereby the slip of the fusing film 110 is restrained.

Further, the rotating member 170A is coupled with the pressure roller 150. Therefore, the rotating member 170A provides the fusing film 110 with the driving force from inside, thereby the rotating of the fusing film 110 can be assisted.

Further, the pair of bias members 171 is disposed outside of the sheet conveying region W in the left-right direction. Therefore, it is prevented that the pair of bias members 171 interrupts the thermal fix.

Further, the pair of bias member 171 is disposed so as to overlap the nip portion NP as viewed from the left-right direction. Therefore, it becomes possible to reliably bias the fusing film 110 to the peripheral surface 150A of the pressure roller 150. Note that the pair of bias member 171 may be not disposed so as to overlap the nip portion NP as viewed from the left-right direction. However, it is preferable that the pair of bias member 171 is disposed so as to overlap the nip portion NP as viewed from the left-right direction, in order to reliably bias the fusing film 110 to the peripheral surface 150A of the pressure roller 150.

Further, the pair of bias members 171 is isolated from the nip plate 130. Therefore, it becomes easy to adjust the biasing force of the pair of bias members 171 compared with when a bias member is integrally formed on the nip plate 130.

Further, each bias member 171 is disposed in the corresponding through-hole 131. Therefore, it becomes easy to adjust the biasing force of the pair of bias members 171.

Further, each rotating member 170 is rotatably supported by the pair of supporting members 132 disposed at both sides of the pair of through-holes 131 in the left-right direction. Therefore, the rotating member 170 can bias the fusing film 110 to the pressure roller 150 without interrupting the movement of the fusing film 110.

Further, each supporting member 132 is integrally formed on the nip plate 130. Therefore, it is not necessary to provide a supporting member isolated from the nip plate 130.

Note that if a bias member 171 has a small diameter, the bias member 171 contacts the fusing film 110 with a small area. In such case, parts of the fusing film 110 that contacts the bias member 171 can deform compared with parts of the fusing film 110 that does not contact the bias member 171. Therefore, it is preferable to use a bias member 171 having a large diameter. At a manufacturing stage, the position of each supporting member 132 supporting the bias member 171 can be determined based on a desired protruding distance and a possible diameter of the bias member 171.

For example, if there is a large space to dispose the bias member 171, it becomes possible to use a bias member 171 having a larger diameter. As the result, a desired protruding distance is available without deforming the fusing film 110. On the other hands, if there is a small space to dispose the bias member 171, a bias member 171 having a smaller diameter is used. However, if the fusing film 110 can be deformed by the bias member 171 having the smaller diameter, the protruding diameter may be reduced although the bias force is reduced.

In the first embodiment, each rotating member 170 is supported by the nip plate 130. However, the rotating member 170 may be supported by a member other than the nip plate 130.

Figure 5:
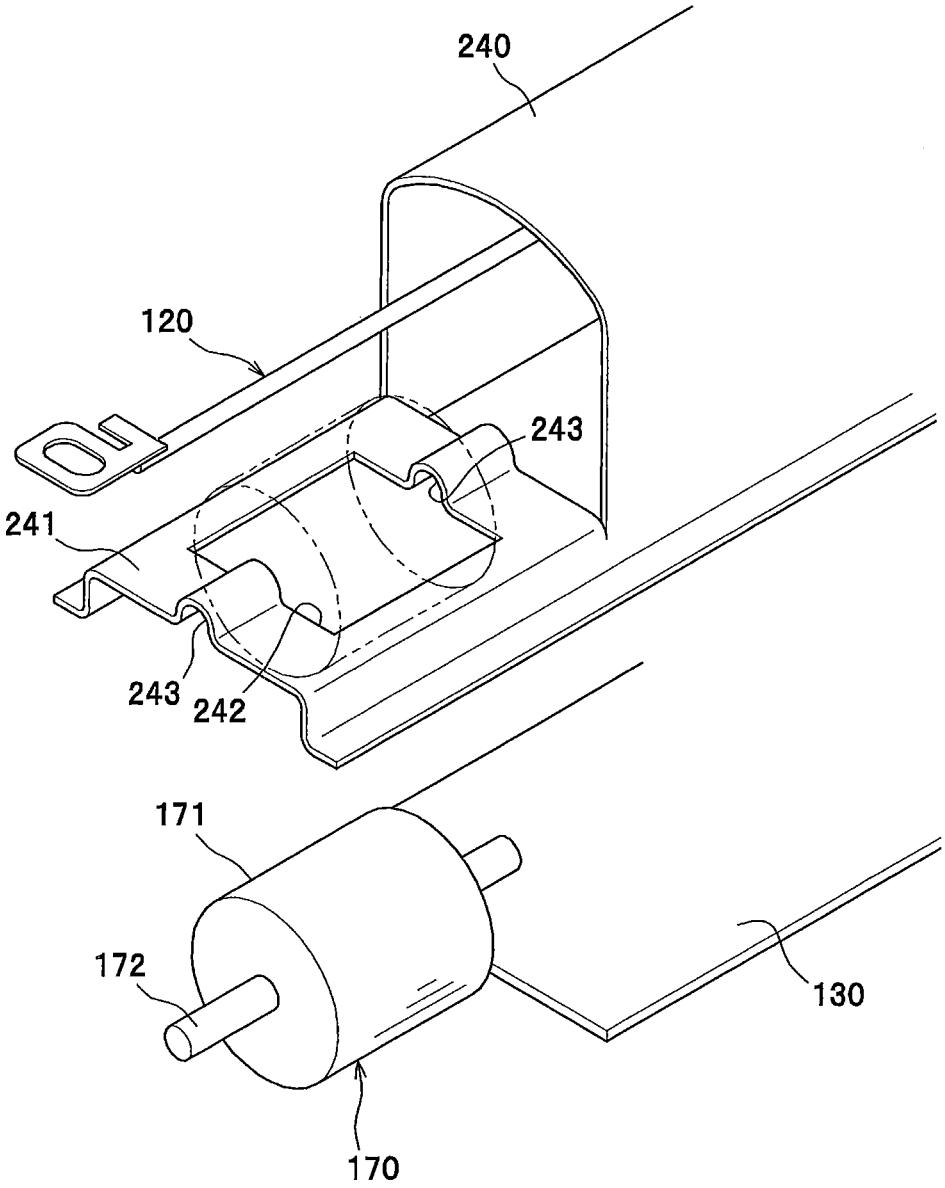
FIG. 5 is a perspective view showing a nip plate and a reflection plate according to a variation of the first embodiment.

For example, as shown in FIG. 5, the rotating member 170 may be supported by a reflection plate 240 at the outside of the nip plate 130 in the left-right direction.

Specifically, the reflection plate 240 has a pair of deformed parts 241 formed with sheet-metal processing at both ends in the left-right direction. Each deformed part 240 has a through-hole 242 for accepting the bias member 171 of the corresponding rotating member 170 and a supporting member 243 disposed at both ends of the through-hole 242 in the left-right direction to support the rotational shaft 172 of the corresponding rotating member 170.

Thus, even if the rotating member 170 is supported by a member other than the nip plate 130, the slip of the fusing film 110 can be restrained.

Second Embodiment

Figure 6A:
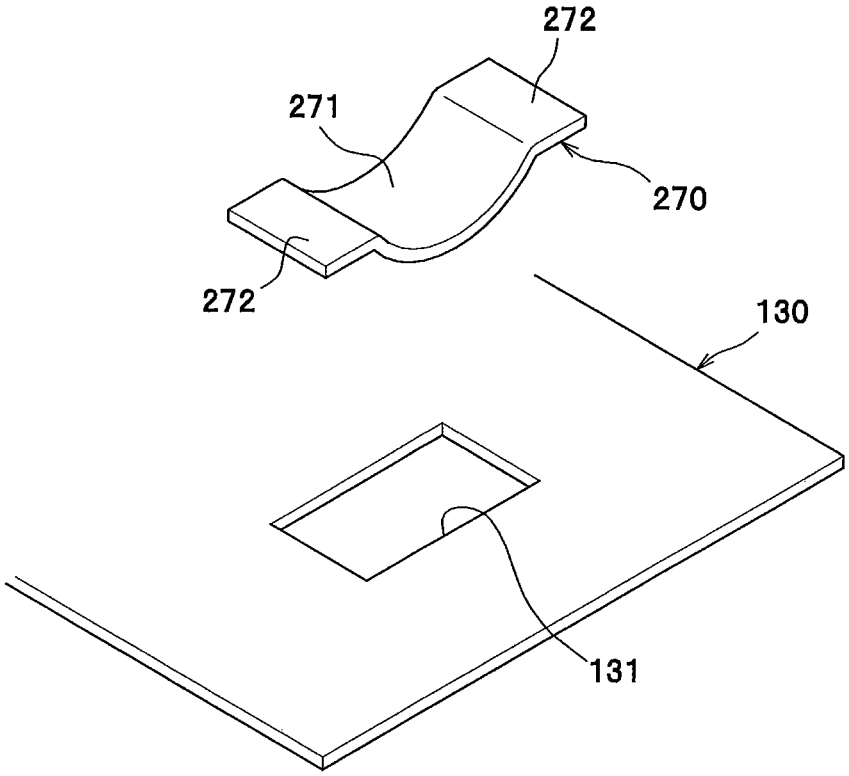
FIG. 6(*a*) is a perspective view showing a nip plate according to a second embodiment of the present invention.
Figure 6B:
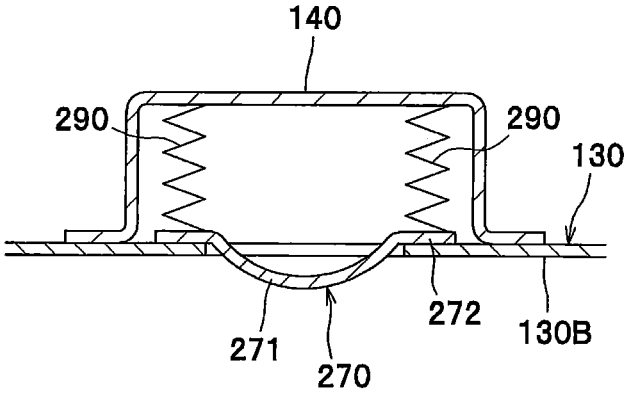

Next, a fixing device according to a second embodiment of the present invention will be described with references. In the present embodiment, as shown in FIG. 6(*a*), a pair of plate-like members 270 that does not rotate is used instead of the pair of rotating members 170. Like parts and components are designated by the same reference numerals as the first embodiment to avoid duplicating description.

As shown in FIGS. 6(*a*) and 6(*b*), in the present embodiment, each plate-like member 270 has a curved bias part 271 disposed in the corresponding through-hole 131 and a pair of flange portions 272 that protrudes in the front-rear direction from both ends of the bias member 271, respectively.

The pair of flange portions 272 is fixedly biased to edges of the through-hole 131 by a compression spring 290. The bias part 271 protrudes downwards than the lower surface 130B of the nip plate 130 through the through-hole 131 to bias the fusing film 110 to the peripheral surface 150A of the pressure roller 150.

Thus, even if the plate-like member 270 that does not rotate is used instead of the rotating member 170, the bias part 271 can bias the fusing film 110 to the pressure roller 150, thereby the rotating of the fusing film 110 can be assisted.

Figure 7:
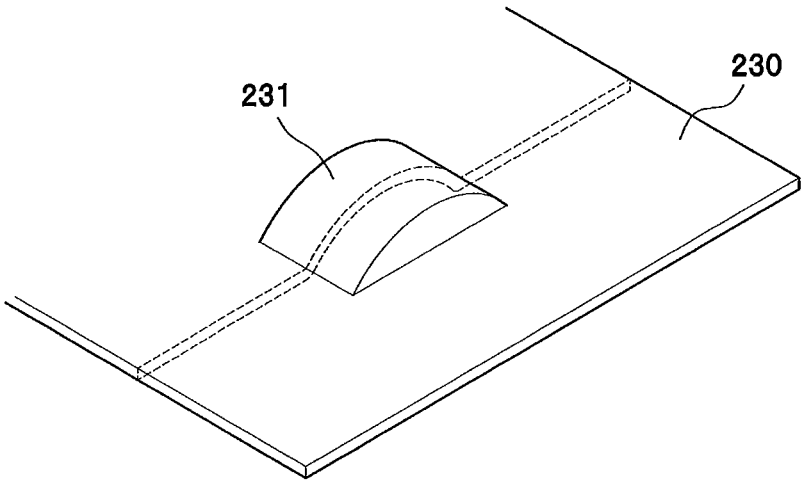
FIG. 7 is a perspective view showing a nip plate according to a variation of the second embodiment.

In the second embodiment, the bias member 271 (plate-like member 270) is isolated from the nip plate 130. However, as shown in FIG. 7, a bias member 231 may be integrally formed on a nip plate 230.

Specifically, the bias member 231 is integrally formed on the nip plate 230 with sheet-metal processing and has a convex shape protruding toward the pressure roller 150. With this construction, the number of the components can be reduced.

While the invention has been described in detail with reference to the embodiment thereof, it would be apparent to those skilled in the art that various changes and modifications may be made therein without departing from the spirit of the invention.

A thicker member that does not have a plate shape may be used instead of the nip plate 130, for example.

A belt-like pressure member may be used instead of the pressure roller 150, for example.

An OHP, a plain paper, and a post card sheet can be used as the sheet P, for example.

Further, an LED printer that performs an exposure with an LED, a copier, or a multifunction peripheral may be used instead of the laser printer 1, for example. Further, an image-forming device that forms a color image may be used as the laser printer 1, for example.

What is claimed is:

1. A fixing device comprising:

a flexible tubular member;

a nip member having a contact surface configured to be in contact with an inner peripheral surface of the flexible tubular member; and a backup member, the backup member and the contact surface of the nip member being configured to pinch the flexible tubular member therebetween, wherein the contact surface includes:

a first portion, the first portion and the backup member being configured to pinch the flexible tubular member therebetween; and a second portion extending from the first portion and protruding from the first portion toward the backup member, the second portion and the backup member being configured to pinch the flexible tubular member therebetween, wherein the flexible tubular member is configured to move in a moving direction between the nip member and the backup member, and wherein a dimension of the second portion in the moving direction is greater than a dimension of the second portion in a direction parallel to an axis of the flexible tubular member.

2. The fixing device according to claim 1, wherein the second portion has a convex shape.

3. The fixing device according to claim 2, wherein the second portion has a convex shape when viewed from a direction parallel to an axis of the flexible tubular member.

4. The fixing device according to claim 1, wherein the nip member includes a metal plate.

5. The fixing device according to claim 4, wherein the nip member is the metal plate.

6. The fixing device according to claim 5, further comprising a heater spaced apart from the nip member.

7. A fixing device comprising:

a flexible tubular member;

a nip plate having a contact surface that is configured to be in contact with an inner peripheral surface; and a backup roller, the backup roller and the contact surface being configured to pinch the flexible tubular member, wherein the contact surface includes:

a first portion, the first portion and the backup roller being configured to pinch the flexible tubular member therebetween;

a second portion extending from the first portion and protruding from the first portion toward the backup roller, the second portion and the backup roller being configured to pinch the flexible tubular member therebetween; and a third portion extending from the first portion and protruding from the first portion toward the backup roller, the third portion and the backup roller being configured to pinch the flexible tubular member therebetween, the third portion being spaced away from the second portion in a direction parallel to an axis of the tubular member.

8. The fixing device according to claim 7, wherein the second portion is parallel to the third portion.

9. The fixing device according to claim 7, wherein the flexible tubular member is configured to move in a moving direction between the nip plate and the backup roller, wherein the second portion is parallel to the moving direction, and the third portion is parallel to the moving direction.

10. The fixing device according to claim 7, wherein the second portion has a convex shape, and the third portion has a convex shape.

11. The fixing device according to claim 10, wherein the second portion has a convex shape when viewed from a direction parallel to an axis of the flexible tubular member, and the third portion has a convex shape when viewed from a direction parallel to the axis of the flexible tubular member.

12. The fixing device according to claim 7, wherein the flexible tubular member is configured to move in a moving direction between the nip plate and the backup roller, wherein a dimension of the second portion in the moving direction is greater than a dimension of the second portion in a direction parallel to the axis of the flexible tubular member, and a dimension of the third portion in the moving direction is greater than a dimension of the second portion in a direction parallel to the axis of the flexible tubular member.

13. The fixing device according to claim 7, wherein the nip plate includes a metal plate.

14. The fixing device according to claim 13, wherein the nip plate is the metal plate.

15. The fixing device according to claim 7, further comprising a heater spaced apart from the nip plate.

16. The fixing device according to claim 7, wherein the second portion of the contact surface of the nip plate is opposite to the third portion relative to an imaginary plane that passes a center of the nip plate in a direction parallel to the axis of the flexible tubular member.

17. The fixing device according to claim 16, wherein the flexible tubular member and the backup roller are configured to convey a sheet therebetween, and wherein a distance between the second portion and the third portion is greater than a dimension of the sheet that is to be conveyed between the flexible tubular member and the backup roller.

18. The fixing device according to claim 17, wherein the flexible tubular member includes a film.

19. The fixing device according to claim 7, wherein the contact surface of the nip plate is configured to contact the inner peripheral surface of the flexible tubular member via grease.

20. The fixing device according to claim 1, wherein the contact surface of the nip member is configured to contact the inner peripheral surface of the flexible tubular member via grease.

21. A fixing device comprising:

a flexible tubular member;

a nip member having a contact surface that is configured to be in contact with an inner peripheral surface; and a backup roller, the backup roller and the contact surface being configured to pinch the flexible tubular member, wherein the contact surface has:

a first portion, the first portion and the backup roller being configured to pinch the flexible tubular member therebetween;

a second portion extending from the first portion and protruding from the first portion toward the backup roller, the second portion and the backup roller being configured to pinch the flexible tubular member therebetween; and a third portion extending from the first portion and protruding from the first portion toward the backup roller, the third portion and the backup roller being configured to pinch the flexible tubular member therebetween, the third portion of the contact surface of the nip member being opposite to the second portion relative to an imaginary plane that passes a center of the nip member in a direction parallel to an axis of the flexible tubular member, the imaginary plane being perpendicular to the axis of the flexible tubular member.

22. The fixing device according to claim 21, wherein the flexible tubular member and the backup roller are configured to convey a sheet therebetween, and wherein a distance between the second portion and the third portion is greater than a dimension of the sheet that is to be conveyed between the flexible tubular member and the backup roller.

23. The fixing device according to claim 22, wherein the contact surface of the nip member is configured to contact the inner peripheral surface of the flexible tubular member via grease.

* * * * *